United States Patent [19]

Calcagno et al.

[11] 4,428,540

[45] Jan. 31, 1984

[54] APPARATUS FOR MAINTAINING THE RELATIVE POSITION BETWEEN WIRE BEING FED ONTO A BOBBIN AND WIRE WOUND ABOUT THE BOBBIN FOR FORMING A COIL OF WIRE

[76] Inventors: Kenneth H. Calcagno, 1161 Westbrook Rd., West Milford, N.J. 07480; William F. Calcagno, Jr., 22 Russell Rd., Ringwood, N.J. 07456

[21] Appl. No.: 370,359

[22] Filed: Apr. 21, 1982

Related U.S. Application Data

[63] Continuation-in-part of Ser. No. 104,785, Dec. 18, 1979, abandoned.

[51] Int. Cl.[3] ..... B65H 54/04; B65H 54/28

[52] U.S. Cl. ..... 242/25 R; 242/7.13; 242/7.14; 242/7.15; 242/158 R; 242/158 F; 242/158.4 R

[58] Field of Search ..... 242/25 R, 18 R, 158 R, 242/158 F, 158.1, 158.2, 158.3, 158.4 R, 158.4 A, 157.1, 7.03, 7.15, 7.16, 7.14, 7.13

[56] References Cited

U.S. PATENT DOCUMENTS

| | | | |
|---|---|---|---|
| 2,626,765 | 1/1953 | Biddison | 242/158 F |
| 2,990,136 | 6/1961 | Wilkinson | 242/157.1 |
| 3,152,773 | 10/1964 | Brown | 242/157.1 |
| 3,370,808 | 2/1968 | Cox et al. | 242/158.4 R |
| 3,544,035 | 12/1970 | Woolever | 242/158 R |
| 3,565,357 | 2/1971 | Noguchi | 242/25 R |
| 3,779,480 | 12/1973 | Cambou | 242/158 R |
| 3,815,846 | 6/1974 | Biewer | 242/157.1 X |
| 3,989,200 | 11/1976 | Bachi | 242/7.03 |
| 4,022,391 | 5/1977 | Stein et al. | 242/158.4 R X |
| 4,163,531 | 8/1979 | Miller et al. | 242/158 R |

FOREIGN PATENT DOCUMENTS

| | | | |
|---|---|---|---|
| 1094425 | 12/1968 | Fed. Rep. of Germany | 242/158.4 R |
| 2322687 | 11/1973 | Fed. Rep. of Germany | 242/158 F |
| 2419182 | 10/1975 | Fed. Rep. of Germany | 242/25 R |
| 896016 | 4/1944 | France | 242/158 R |
| 1126871 | 7/1956 | France | 242/158 R |
| 2022636 | 12/1979 | United Kingdom | 242/25 R |

*Primary Examiner*—Stanley N. Gilreath
*Attorney, Agent, or Firm*—Arnold D. Litt

[57] ABSTRACT

An apparatus for maintaining the relative position between wire being fed onto a bobbin and wire wound about the bobbin for forming a coil comprising guide means for guiding the wire onto the bobbin; a sensing arm movably responsive to shifting of the wire upon winding thereof onto the bobbin and displacing means for synchronously displacing the guide means dependent upon the position of the wire wound about the bobbin. The displacing means comprises, preferably, a balanced rotary hydraulic servo-valve, a shaft which connects the sensing arm and the servo-valve, and a hydraulic cylinder secured to the servo-valve, shiftably moveable relative to the bobbin, responsive to movement of the sensing arm, such that as the angle between the wire being fed onto the bobbin and the wire wound about the bobbin changes, the sensing arm is displaced thereby actuating said displacing means and causing movement of said guide means thereby re-establishing the relative position between the wire being fed onto the bobbin and wire wound about the bobbin.

As the wire is fed onto the bobbin thereby forming a coil, the sensing arm shifts and, through the shaft, generates an error from null in the servo-valve. The hydraulic cylinder, secured to the servo-valve housing, shifts responsive to such error from null, thereby moving the guide means, through movement of the servo-valve and shaft, to re-establish such null.

14 Claims, 22 Drawing Figures

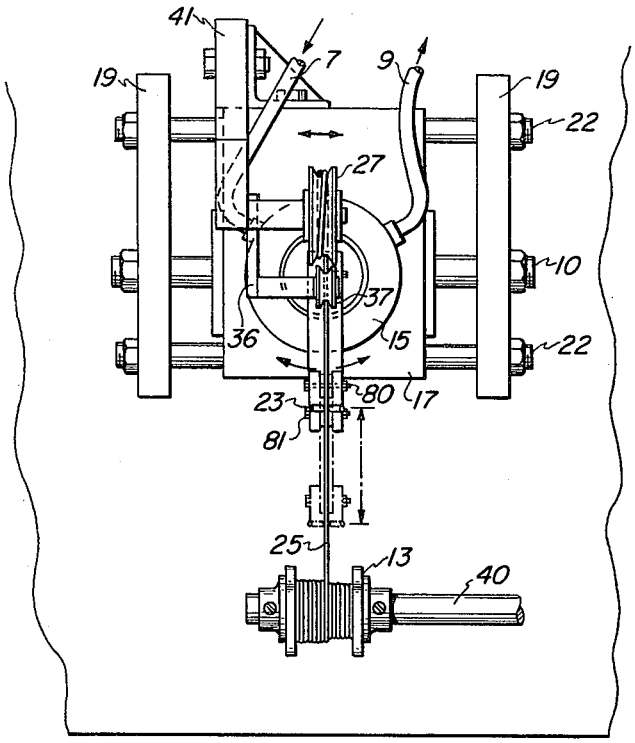
Fig. 8
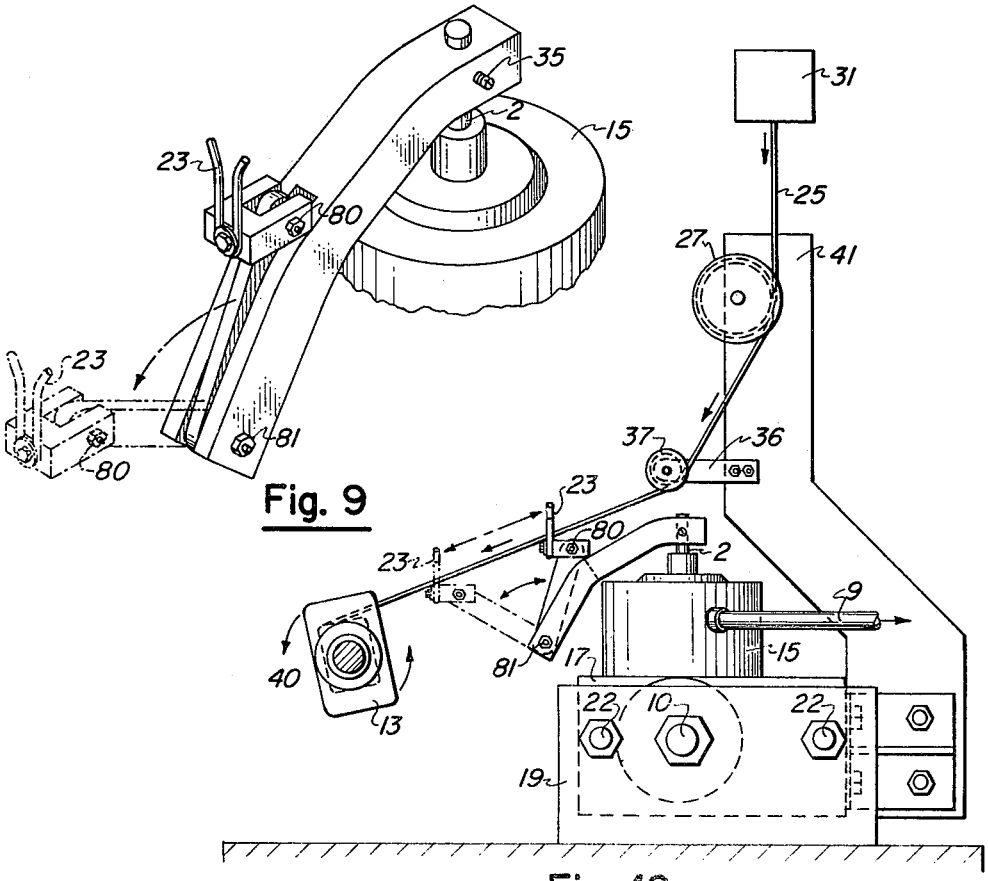
Fig. 9
Fig. 10

SECTION A-A

APPARATUS FOR MAINTAINING THE RELATIVE POSITION BETWEEN WIRE BEING FED ONTO A BOBBIN AND WIRE WOUND ABOUT THE BOBBIN FOR FORMING A COIL OF WIRE

RELATIONSHIP TO OTHER APPLICATIONS

This is a continuation-in-part of application U.S. Ser. No. 06/104,785 filed Dec. 18, 1979 to Kenneth H. Calcagno and William F. Calcagno, Jr. for "An Apparatus For Maintaining the Relative Position Between Wire Being Fed Onto a Bobbin and Wire Wound About the Bobbin for Forming a Coil of Wire," now abandoned.

BACKGROUND OF THE INVENTION

1. Field of the Invention

This invention relates to an apparatus for automatically winding wire, preferably fine wire, in what is termed in the art as perfect layer coil winding. The placement of the wire in perfect layer winding is characterized by being a non-helix winding, every turn of which is substantially orthocyclic. For further amplification concerning perfect layering, see, for example, U.S. Pat. No. 3,989,200 issued Nov. 2, 1976 to Bachi Inc.

2. Description of the Prior Art

In the past, prior art apparatuses have attempted to maximize the efficiency with respect to obtaining perfect wiring on bobbins of varying sizes and shapes. Thus, for example, in U.S. Pat. No. 3,565,357, issued Feb. 23, 1971 to Tokyo Shibaura Electric Co., Ltd., the teachings of which are incorporated herein by reference, a fine wire winding device is taught. A guide pulley for feeding the length of the wire to a bobbin is arranged to follow a wire winding point on the bobbin with a space and move in parallel with said point with a predetermined inclination, in such a manner that the wire to be wound forms a predetermined angle with respect to the wire already wound about the bobbin. Control means is also provided for mechanically reversing the direction of movement of the guide pulley when the wire winding point approaches the ends of the bobbin, so that the guide pulley may reciprocate to effect the wire winding operation in the reverse direction. The system taught is a purely mechanical system wherein the sensing device for maintaining constant angularity in the wire to be wound and the wire already wound, comprises a bevel bearing riding on a rotating shaft. As the tensioned wire moves along the rotating bobbin, thereby changing the angularity of the wire, the bevel bearing falls off from its normal perpendicular position relative to the rotating shaft. The angularity between the bevel bearing and the rotating shaft causes the guide block upon which the guide arm rests, to move in the direction of the winding thereby re-establishing the predetermined inclination.

Unfortunately, the sensing device utilized in the '357 patent, results in substantial slippage between the bearing and the shaft and a diminution in sensitivity. In addition, the process results in rapid and substantial wear and tear on the shaft. The correcting forces generated by this system are very low, making the system subject to outside forces. If the pre-load on the bearing is increased, the wear factor becomes even greater. Minor contamination of the shaft surface can result in substantial drop-off in winding sensitivity. Furthermore, there are substantial vibrational forces due to the inherent nature of the process causing drop off in sensitivity. Moreover, the neutral position of the arm and wire have to be predetermined and pre-established by way of a springing of the sensing arm. Finally, the process generates such noise that operators must wear ear plugs or other devices to shield themselves from the noise.

Other patents have described winding apparatuses which utilize electric components in the sensing device. Thus, for example, in U.S. Pat. No. 3,779,480 to Cambou, an electrically operated winding system is disclosed. A wheatstone bridge functions as the basis for maintaining the constant angularity required in coil winding. Difficulties, however, have existed in terms of expense in the operation and maintenance of the apparatus as well as in the large number of movable parts.

In U.S. Pat. No. 2,990,136 to Wilkinson, a coil winding apparatus is taught wherein the wire guide is mechanically liked to a rotary fluid control valve which operates to supply fluid to a differential piston such that a translation motion is produced in the wire guide assembly. In Wilkinson, a pneumatic device is taught. The apparatus works against a biassed piston.

In. U.S. Pat. No. 4,022,391 to Stein, there is disclosed a coil winding device which utilizes an electrical angle sensor in the wire guide assembly to produce an error signal which controls a translational motion in the bobbin. Sensing means in Stein senses the gauge of the wire in establishing position.

In all of the above systems, substantial variation in sensitivity has been noted thereby diminishing their utility.

Moreover, the mechanisms require expensive parts which lead to increased costs with respect to their operation. Many of the systems such as taught in U.S. Pat. No. 3,565,357, supra, have high vibrational behavior which results in a substantial decrease in the ability of the system to lay down the wire in a predetermined manner. Furthermore, several of the systems suffer from rapid wear and tear of the component parts.

The instant invention solves many of the problems faced by prior art processes such as those associated with the U.S. Pat. No. 3,565,357. Thus, utilization of the instant winding apparatus results in elimination to a substantial degree of vibronic factors which would result in a decrease in sensitivity; increased wire winding sensitivity; diminution in the wear and tear on the component parts of the systems; substantial reduction in noise generated by operation of the apparatus; and the development of a substantially automatic system which requires little attention by an operator.

Moreover, the instant apparatus, in terms of the cost of the manufacture and operation of the same, results in substantial cost savings.

SUMMARY OF THE INVENTION

The instant invention as illustrated more particularly in the preferred embodiments set forth in the drawings following hereafter, comprises an apparatus for maintaining a relative position between wire being fed onto a bobbin and wire wound about the bobbin for forming a coil, comprising a guide means for guiding the wire onto the bobbin, a sensing arm movably responsive to shifting of the wire upon winding of the same onto the bobbin, and displacing means associated therewith for synchronously displacing the guide means dependent upon the position of the wire wound about the bobbin, whereby as the angle between the wire being fed onto the bobbin and the wire wound about the bobbin changes, the sensing arm is displaced thereby actuating said displacing means and causing movement of said guide means to re-establish the releative position between the wire being fed onto the bobbin and wire wound about the bobbin.

The displacing means comprises a hydraulically balanced hydro-mechanical servo-valve, preferably a rotary servo-valve, connecting means, connecting said sensing arm to said servo-valve, and a hydraulic cylinder containing a piston and piston rod, said hydraulic cylinder and piston being in operational communication with the servo-valve, said hydraulic cylinder being shiftably moveable relative to the bobbin and responsive to movement of the sensing arm, said cylinder movements being in a direction such that the guide means moves to a position so as to re-establish the relative position of the wire being fed onto the bobbin and the wire wound about the bobbin.

In one embodiment the sensing arm has sensing fingers at one end on either side of the wire emanating from wire supply means and which is about to be wound about the bobbin.

As the bobbin rotates, the wire about to be wound senses or touches the previous wire turn or the bobbin structure and is physically displaced forming the next wire turn; this results in pressure against the sensing fingers causing the sensing arm to shift and, through the shaft, to generate an error or displacement from null, in the hydraulically balanced servo-valve. The hydraulic cylinder, in a preferred embodiment of the invention, is secured to the hydraulic servo-valve housing and shifts responsive to such error from null, thereby moving the guide means, through the movement of the servo-valve housing and shaft, re-establishing such null, thereby re-establishing the relative position of the sensing arm to the axis of rotation of the bobbin, substantially perpendicular.

In another embodiment of the invention, the hydraulic cylinder is separate from the hydraulic servo-valve housing, but the piston and piston rod contained therein are in operational communication with the housing of the hydraulic servo-valve, so that upon movement of the piston, the servo-valve housing and, accordingly, the servo-valve move synchronously therewith, thereby causing resultant movement of the guide means back to the null position. Pulleys are provided throughout the apparatus to maintain tension on the wire.

It is noted that any thickness or gauge or wire may be used in the instant invention, although it finds particular use in connection with fine wire.

Additional details and clarifications concerning the invention are obtained by reference to the following drawings.

BRIEF DESCRIPTION OF THE DRAWING

FIG. 8 is a plan view of a third embodiment of the invention.

FIG. 9 is an isometric view of the sensing arm used in FIG. 8.

FIG. 10 is a side elevational view of FIG. 8.

DETAILED DESCRIPTION OF THE DRAWING

Reference is first made to FIGS. 1 through 5 showing a first embodiment of the invention.

Figure 1:
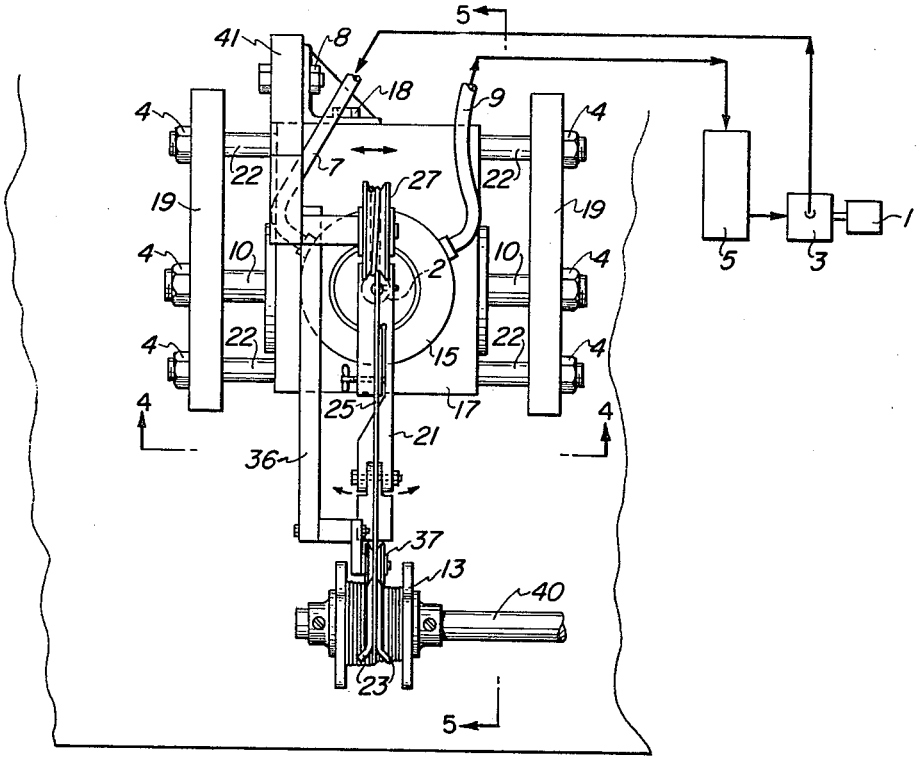
FIG. 1 is a plan view of a first embodiment of the invention.

In FIG. 1, a plan view of a first embodiment is shown. The apparatus displayed is utilized to maintain the relative position between wire being fed onto a bobbin and wire wound about the bobbin for forming a coil. The instant invention finds primary utility in perfect layer winding. The apparatus comprises a sensing arm, 21, with radial sensing fingers, 23, for sensing the position of the wire as it is wound onto the bobbin, said arm being movably responsive to shifting of the wire upon winding of the same onto the bobbin, 13.

Figure 2:
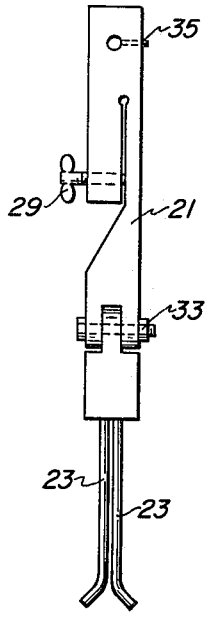
FIG. 2 is an enlarged plan view of the sensing arm used in FIG. 1.

The sensing arm configuration is displayed more clearly in FIG. 2. In one embodiment, the sensing arm contains a pivot adjusting screw, 33, permitting movement of the sensing fingers, 23, from a position of alignment with the longitudinal axis of the sensing arm to a position of non-alignment with said axis; (with reference to FIG. 5, as the fingers are moved closer to the bobbin, a greater displacement of wire is sensed by the sensing fingers generating an error in the servo-valve (to be discussed in more detail below), relative to moving the fingers further from the bobbin, in which case a smaller displacement of wire is sensed generating a corresponding error); a fine adjustment screw, 29, for providing fine adjustment to the lead-lag of the wire being wound on the bobbin, and a set screw, 35, for providing a pivot point with respect to which the sensing arm may move in an arc, allowing it to track the movement of the wire being wound around the bobbin.

Lead-lag as used herein is defined as follows: "lead'-'—the wire placed on the spool slightly ahead of the required position in terms of axial travel with respect to the wound bobbin, necessitating the wire to fall back into place; "lag"—the wire placed on the bobbin slightly behind the required position in terms of axial travel with respect to the wound bobbin, necessitating the wire to fall ahead into place. This adjustment is needed to compensate for slight imperfections in the bobbin in order to lay the wire correctly.

Figure 6:
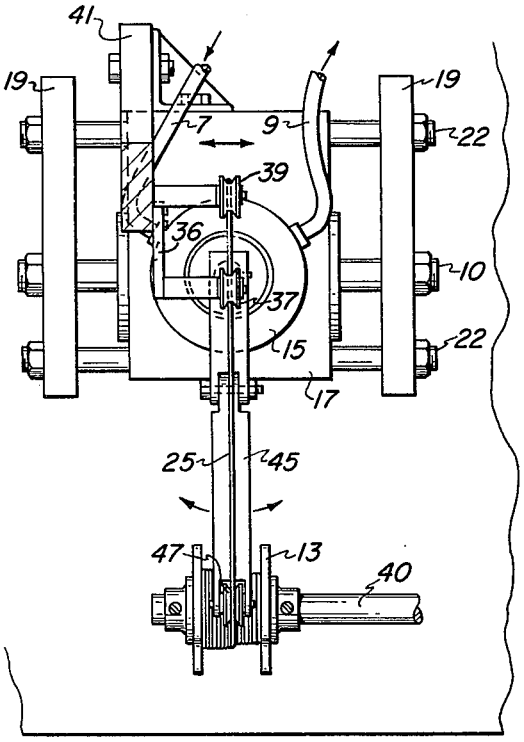
FIG. 6 is a plan view of embodiment 2 at cut 6—6 in FIG. 7.
Figure 7:
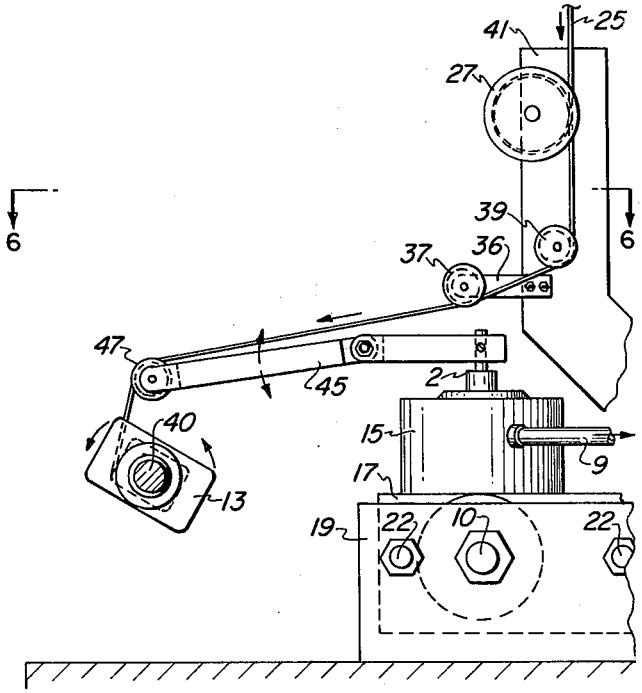
FIG. 7 is a side elevational view of a second embodiment of the invention.

While the sensing fingers as shown in FIG. 2 are not necessary for operation of the instant invention, as will be more fully elaborated upon in conjunction with the configuration depicted in FIGS. 6–7, nevertheless, the fingers add substantial sensitivity to the overall system by: removing wire tension induced load from the valve bearing; reducing transmission of vibration to the valve; better establishing "lead-lag;" and increasing sensitivity because of low loads.

Figure 16:
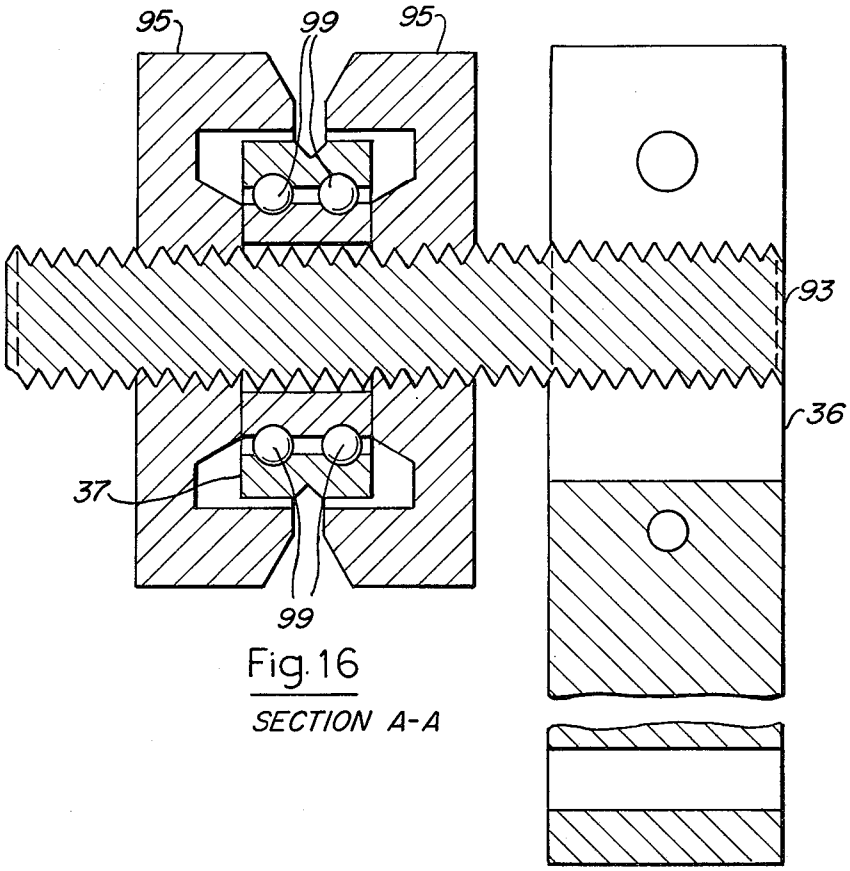
FIG. 16 is a sectional view of the lead-lag adjustment assembly along cut line A—A in FIG. 17.
Figure 17:
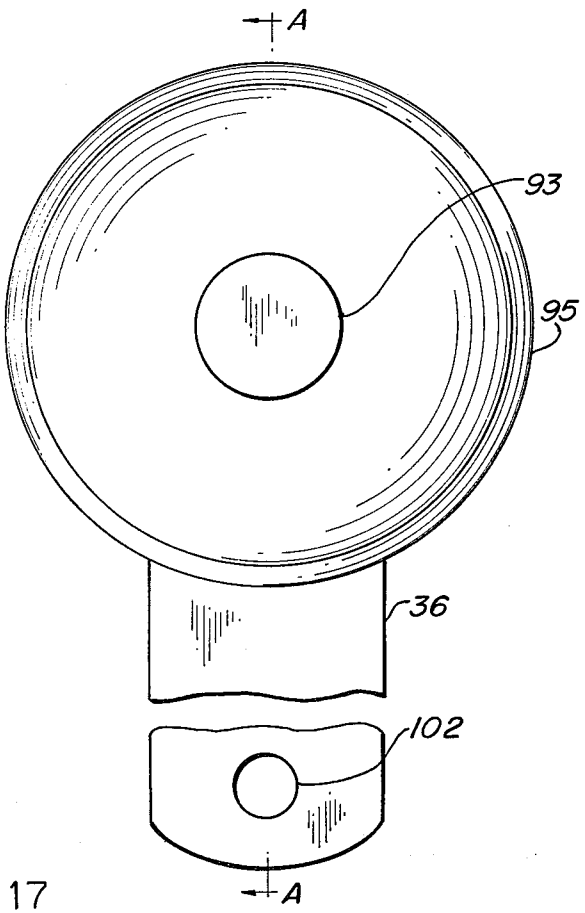
FIG. 17 is a front view of the lead-lag adjustment assembly.

With reference to FIG. 2, another embodiment of the invention contemplates elimination of adjustment screw 29; instead, lead-lag can be controlled by mounting pulley 37 on a threaded rod situated at the end of arm 36 (FIG. 5) and located substantially perpendicular to said arm passing through it. Lock nuts are provided so that the pulley can be moved back and forth along the threaded rod parallel to the axis of rotation of the bobbin and, accordingly, control the lead-lag adjustment. This is shown in FIGS. 16 and 17. In FIG. 16 threaded rod 93 extends from arm 36. Pulley 37 is situated between lock nuts 95 permitting movement of pulley 37 along the threaded rod in a direction parallel to the axis of rotation of the bobbin. Ball bearings 99 add axial and radial stability and allow facile movement of pulley 37. Arm 36 is adjustable about pivot bearing 102 (FIG. 17) which allows movement of the guide pulley 37 closer to or further from the bobbin. FIG. 17 is a front view of FIG. 16 showing cut line A—A. This configuration permits lead-lag adjustment while the apparatus is running. The lock nuts serve to shield the moving pulley 37, to aid in guiding the wire into the "V" groove of the pulley and hold the pulley in position on the threaded rod.

Said sensing arm is pivotally mounted by said set screw, 35 (FIG. 2), to a hydraulic servo-valve, 15, which is in turn mounted to a guide block, 17. Said guide block is shown more clearly in FIG. 11 which will be elaborated upon in detail hereinbelow. For purposes of the present description respecting FIG. 1, said guide block is preferably rectangular in shape, and comprises a hollow cavity which is separated into a plurality of hollow cavities by means of a piston and piston rod which is fixed and unmovable. The guide block itself is movably mounted to a hydraulic cylinder rod, 10, which in turn is mounted to supporting frame, 19. Linear bearing rods, 22, are also provided and extend through the guide block, thereby providing, in combination with hydraulic cylinder rod 10, means for allowing said guide block to move linearly within the confines of said support, 19.

Figure 4:
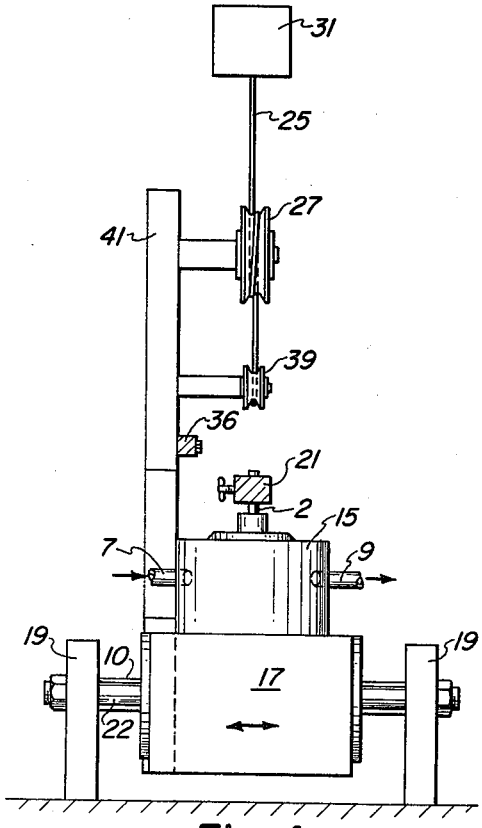
FIG. 4 is a sectional elevation at cut line 4—4 in FIG. 1.

The sensing arm is connected to the hydraulic servo-valve through a shaft, 2, which is shown more clearly in FIG. 4. The combination of sensing arm, shaft and pivot or set point, results in the capability of the sensing arm to move in an arc or, in other words, to swivel about the pivot point in a plane which is substantially parallel to the axis about which the bobbin rotates.

Fastening means 4 are provided in the support framework to allow fastening of the hydraulic cylinder rod and linear bearing rods to support frame. As shown in FIG. 1, flexible hydraulic tubing connects to hydraulic servo-valve, 15, tube 7 leading to pump 3 and tube 9 leading to hydraulic fluid reservoir, 5, whereby hydraulic fluid is pumped through line 7 into hydraulic servo-valve 15, thence into the cylinder causing displacement of fluid on the other side of the cylinder back through the servo-valve, returning to reservoir 5 through line 9. Means for driving the pump is shown as motor 1.

Figure 3:
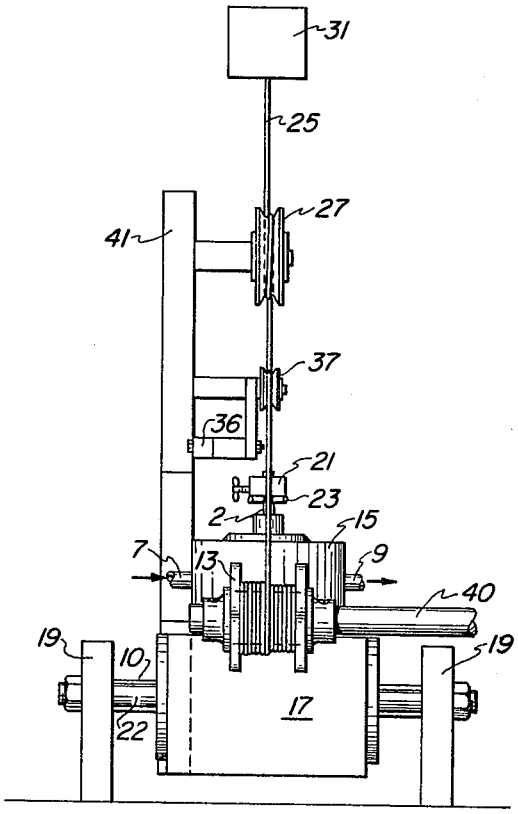
FIG. 3 is a front elevational view of FIG. 1.
Figure 5:
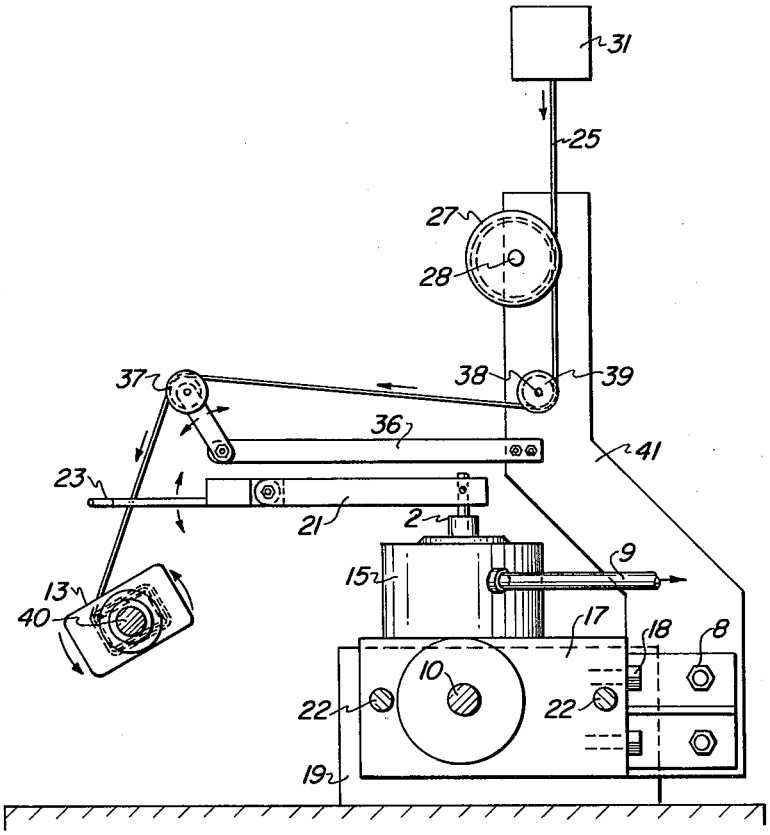
FIG. 5 is a side elevation (partial section) at cut line 5—5 in FIG. 1.

The wire to be wound about the bobbin is led from the supply source, 31, as shown in FIG. 5, through a series of pulleys, 27 and 39, the exact number and size of which will depend upon the nature of the wire to be wound, the diameter of the wire, and the degree of sensitivity to be established. With this limitation in mind, FIGS. 3 and 5 show pulley 27 which is a tensioning pulley to provide tension to the wire, 25. The wire then runs from pulley 27 to pulley 39 (see FIG. 5) where the direction of the wire is changed. The wire then runs to positioning or guide pulley 37, which will preferably comprise a "V" pulley, although any other wire guide known in the art is applicable, so as not to allow any shifting of the wire through vibronic forces, for example. With reference to FIG. 5, it is noted that pulleys 27 and 39 are attached to support frame 41 by way of arms 28 and 38, said pulleys being rotatably mounted to said arms. In addition, guide pulley 37 is connected to said support through arm 36. The support itself may be of any contemplated configuration and is attached at its base by fastening devices 8 and 18, to the guide block 17. This permits the lateral movement of the guide block, to be clarified more fully hereinbelow, to be transmitted to wire which is being wound about the bobbin 13, so that the entire support structure will move in the same direction and to the same degree as any movement in the guide block.

In practice, pulley 37 guides the wire onto the bobbin, and sensing arm 21 is movably responsive to shifting of the wire upon its winding onto the bobbin. Means are provided for synchronously displacing pulley 37 for feeding the wire onto the bobbin, dependent upon the position of the wire wound about the bobbin.

Figure 11:
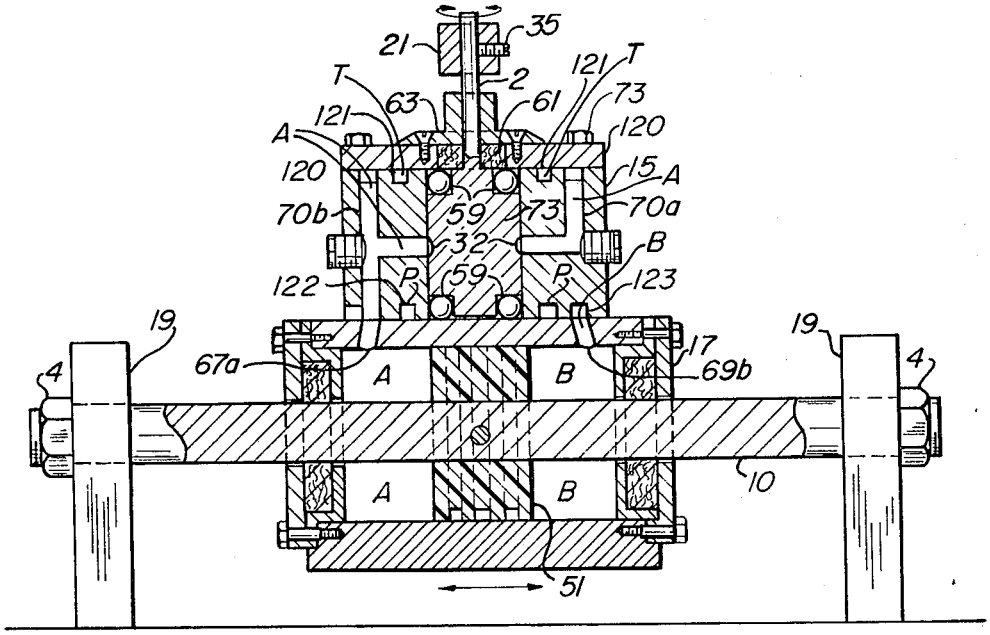
FIG. 11 is a partial sectional view through servo-valve and piston block.

Referring to FIG. 11, the displacing means comprises the hydraulic servo-valve body, 15, a shaft, 2, connecting the sensing arm and the hydraulic servo-valve, and a hydraulic cylinder which is located within the guide block, 17, and secured therein.

Said displacing means is shiftably movable relative to the bobbin, responsive to movement of the sensing arm, in a direction so as to maintain the relative position of the wire windings constant.

Figure 13:
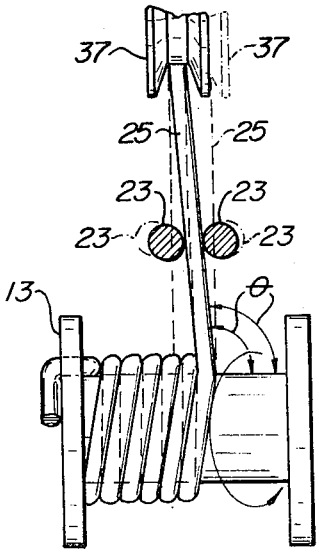
FIG. 13 is a schematic of movements of pulley, wire, sensing arm and bobbin while winding coil on bobbin.

With particular reference to schematic FIG. 13, $\theta$ represents the angle formed by the wire to be wound and the axis of the spool. "Null" position is preferably substantially 90°. As the wire wraps around the spool, it generates an obtuse angularity $\theta$ between the wire which is about to be wound and the axis of the spool (as depicted in FIG. 13, travel direction is left to right). This causes a resultant pressure against the sensing fingers 23, causing a displacement thereof as shown in FIG. 13, the displacement occurring in the direction of the moving wire, in the case of FIG. 13, from left to right. (When the wire winding touches the end of the bobbin, the direction of wire displacement will reverse). The dash line refers to the previous position of the fingers, wire and pulley; the solid line refers to the present position of the fingers, wire and pulley; and the dot-dash line refers to the future position of the fingers, pulley and wire.

Since the arm is pivotably mounted to the hydraulic servo-valve, the lateral movement of the fingers translates itself into movement in the sensing arm along an arc, parallel to the rotational axis of the bobbin, and, as shown in FIG. 13, a left to right motion.

As depicted in FIG. 11, the rotational movement of the sensing arm causes a rotational movement in the shaft 2, which connects the arm to the hydraulic servo-valve, otherwise referred to as a servo-valve spool shaft. This motion translates itself into a rotational motion of the servo-valve spool, 73. The servo-valve spool shaft rotates within a valve shaft seal retainer, 63, passing through a servo-valve shaft seal, 61. The servo-valve spool rides on servo-valve spool bearings, 59. Small channels are cut into the servo-valve spool and are designated 32. In addition, hydraulic passages are provided from the servo-valve to the hydraulic cylinder and are designated 67(*a*) and 69(*b*) respectively.

Shown in FIG. 11, movement of the arm is counterclockwise or from left to right, although the system is bidirectional with every alternate wire layer being set down in the opposite direction. The resulting rotational displacement imparted to the servo-valve spool, allows fluid to enter through line 7 (FIG. 1), from the pump, ultimately entering into cavity B in the cylinder. An equivalent amount of fluid from cavity A is allowed to pass through the servo-valve back into the reservoir. Since the hydraulic piston 51 is fixed in position to the hydraulic cylinder rod 10, the increased pressure in cavity B results in a force which imparts a linear left to right motion of the guide block, thereby restoring the wire to be wound and the sensing arm to a position substantially perpendicular to the axis of rotation of the bobbin.

Stated in other terms, as the wire is fed onto the bobbin, to form a coil, the sensing arm shifts and through servo-valve spool shaft, 2, generates an error from null, in the hydraulic servo-valve. The hydraulic cylinder, secured to the servo-valve, shifts responsive to such error from null and moves the pulley 37 to re-establish such null thereby maintaining the relative position of the wire winding constant and restoring the wire and sensing arm to a substantially perpendicular position relative to the axis of rotation of the bobbin. The resulting motion so observed can be broken down, therefore, into substantially two separate components: (1) wire displacement causing an arc movement of the sensing arm, followed by (2) a substantially linear movement of the guide block and support member 41, tracking movement of the wire displacement.

While a preferred embodiment comprising a rotary hydraulic servo-valve is displayed in the instant invention, any appropriate hydraulic valvular system may be used, such as a balanced linear hydraulic servo-valve.

Figure 12:
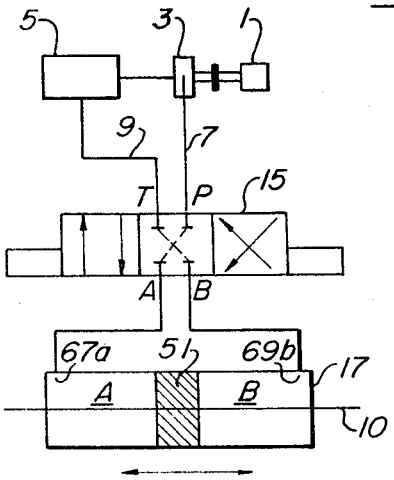
FIG. 12 is a schematic of the hydraulic system through servo-valve and piston block.

Schematically, the operation of the hydraulic servo valvular system, is depicted simplistically in FIG. 12.

An electric motor 1, drives the pump 3, to provide available flow and pressure. The valve system is displayed in the null position. As the valve is shifted mechanically, the valve alters the pressure causing fluid to enter chambers A or B of the cylinder depending on the desired direction of motion. At the same time, fluid is allowed to return to the reservoir 5, from the other chamber. Internal leakage of hydraulic fluid across the servo-valve system is depicted as dotted lines "B-T" and "A-P." The leakage phenomena is desirable and increases the overall sensitivity of the system as described in more detail in connection with FIGS. 18 and 19.

As seen from FIG. 11, the servo-valve is hydraulically balanced. In other words, the displacement means comprises in part a hydraulically balanced hydro-mechanical servo-valve.

As the sensing arm moves counterclockwise, a counterclockwise motion of spool 73 occurs, causing pressure buildup in cylinder B resulting in motion of the guide block 17 to the right. Hydraulic fluid in cylinder A passes through passage 67*a* into axial passage 70*b* and the radial passage portion of 70*b* to channel 32 of spool 73. The fluid enters annular ring passage 120 and flows to axial passage 70*a* via said annular ring passage. The flow proceeds down to the radial passage portion of 70*a* to channel 32 of spool 73, thereby equilibrating pressure on opposite sides of the spool, resulting in a balanced configuration.

By utilizing a balanced system, hydraulic pressure and flow are substantially equalized on opposing sides of the valve spool in all positions thereby reducing the torque required to rotate the spool and increasing the overall sensitivity of the system.

Figure 18:
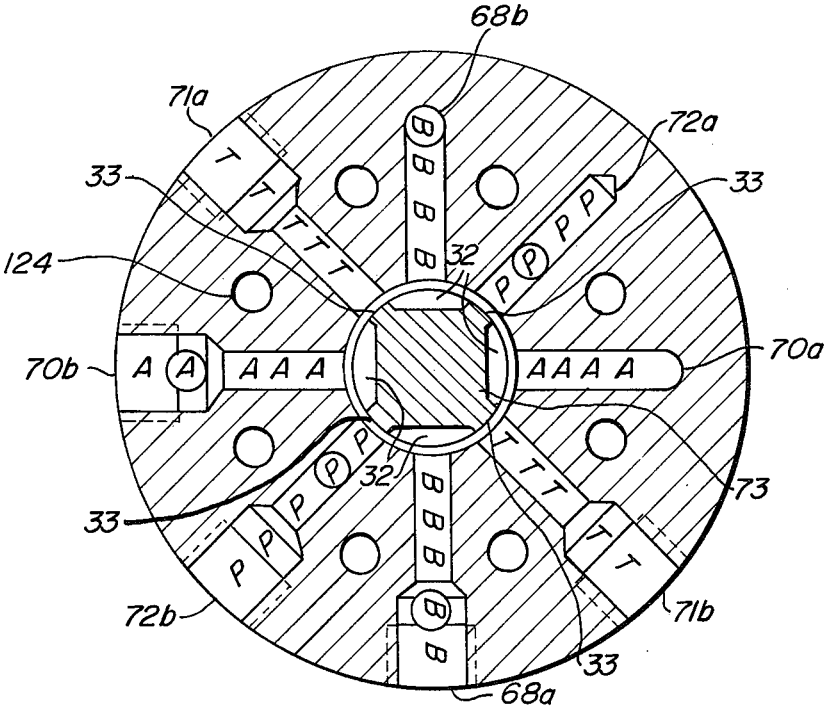
FIG. 18 is a sectional view of the servo-valve through internal radial passages.

With reference to FIG. 18 (showing the valve in the null position), spool 73 has small channels 32 cut into it. Separating the channels are high points of the spool surface referred to as "lands," 33. Hydraulic radial passages are provided which may be circular or rectangular in shape, to permit flow of hydraulic fluid to and from tank and to and from the hydraulic cylinder. Tank or resevoir passages are designated 71*a* and 71*b*, the cylinder A passages are designated 70*a* and 70*b*, and cylinder B passages are designated 68*a* and 68*b*. Pressure passages are designated 72*a* and 72*b* as shown by common lettering on opposite sides of the spool, for example "P" along passages 72*a* and 72*b*, the pressure and flow on opposing sides of the spool are substantially equalized in all positions thereby reducing the torque required to move the spool in response to movement of the sensing arm. This is a key feature of the instant invention and accounts for its extreme sensitivity.

Figure 19:
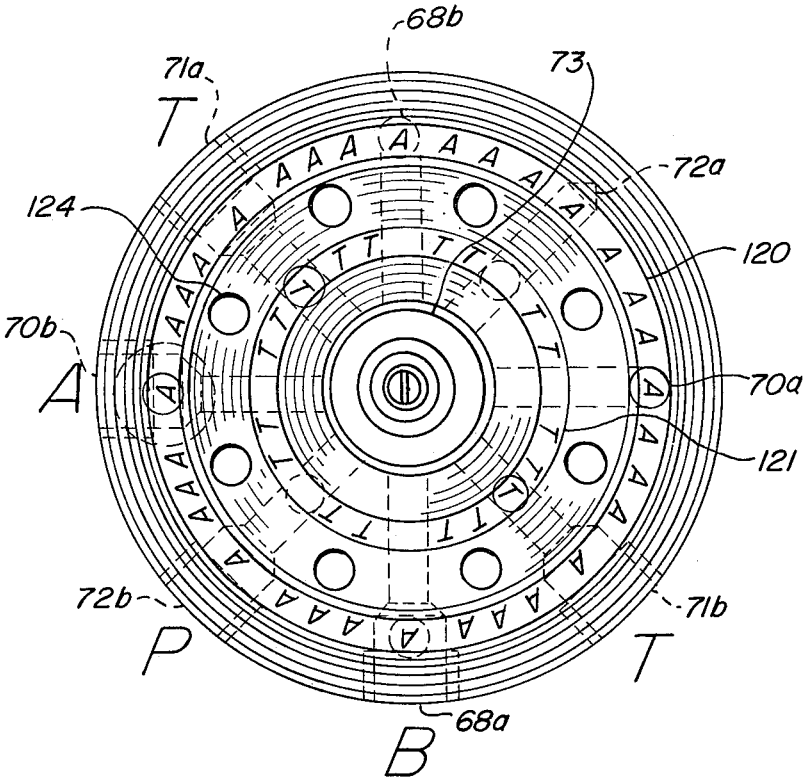
FIG. 19 is a plan view of servo-valve with body cover and gasket removed.

Equalization of pressure and flow on opposite sides of the spool is generated by utilization of annular ring passages, two of which are shown in FIG. 19, i.e., 120 respecting cylinder A and 121 respecting tank, which connect the openings on opposite sides of the spool. Axial passages 70*a* and 70*b* shown in FIG. 11, correspond to axial passages 70*a* and 70*b* shown in FIG. 19. Mounting holes 124 provide means for mounting the valve to the cylinder block. As used in the specification, a hydraulically balanced hydro-mechanical servo-valve, shall mean a servo-valve possessing a balanced configuration, achieved by virtue of substantially symmetrical positioning of passages within the valve body relative to the valve spool, so that the algebraic sum of all axial and radial forces exerted by the hydraulic fluid on the value spool is essentially zero.

FIG. 18 demonstrates another aspect of the instant invention, namely, "negative lap." This refers to the fact that the widths of lands 33 of the valve spool are slightly less than the width of the radial hydraulic passages thereby causing fluid leakage at each corner of each land. Since there are four lands, eight corners are exposed to fluid leakage (this phenomena is alluded to in connection with FIG. 12 supra). The Bernoulli forces generated at each corner tend to keep each land centered in the respective passage openings in the null position. As a result of the negative lap feature, a small rotary displacement of the spool creates a substantial pressure differential across the system and imparts a large restorative force returning the system to the null position.

In a preferred embodiment a cylinder is used having two piston rods having equal areas on either side of the piston. With this type of cylinder at null, when there is no motion within the system, the lands of the spool are located opposite from and are essentially centered relative to the radial openings of the valve body. However, in another embodiment of the invention, a cylinder is used having only one piston rod, resulting in the area on one side of the piston differing from the area on the other side of the piston. With this type of cylinder at null, when there is no motion in the system, the lands of the spool are located opposite from but are not centered relative to the radial openings of the valve body. The pressure on opposite sides of the piston is different. The different pressures acting on unequal areas results in equal force on opposite sides of the piston which balance each other and maintain the system motionless.

While FIG. 11 sets forth a preferred embodiment of the instant invention, (where the piston is rigidly fixed and unmovable, and where the cylinder housing is secured to the servo-valve body, 15) other embodiments may be envisioned which are suitable in the context of the instant invention. Thus, the cylinder, piston and housing may be independent of and separate from the servo-valve body, 15. In this embodiment, the sensing arm would be attached to servo-valve body, 15 (as shown in FIG. 1), through servo-valve spool shaft, 2, forming an independent structure. Flexible hydraulic tubing would then connect servo-valve body, 15, to the hydraulic cylinder parts. In this embodiment, the piston and rod contained in the cylinder would be movable and said rod would be attached to the base of the independent structure previously defined. Accordingly, movement of the piston and rod backwards or forwards results in movement of the structure, in an identical fashion to that envisioned in the preferred embodiment, the structure being movably mounted relative to the fixed bobbin.

In another embodiment, the cylinder rod is attached to one end of the bobbin, said bobbin being movably mounted. The cylinder is fixed and the piston and rod within the cylinder housing move back and forth causing the bobbin to move correspondingly, thereby restoring null. This embodiment finds utility with longer bobbins and larger wire and may be also utilized with multiple bobbin systems.

Figure 14:
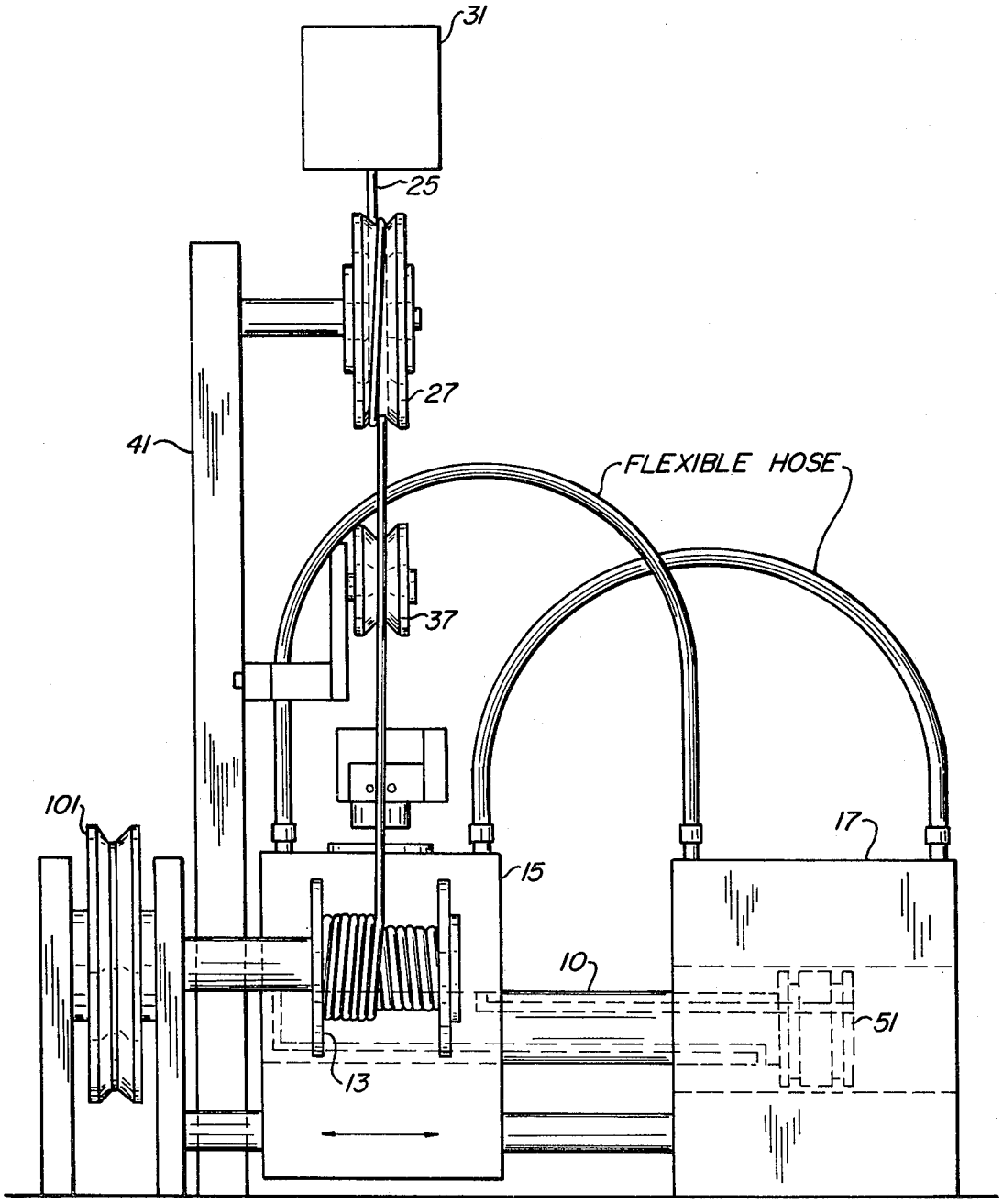
FIG. 14 is a front view of an embodiment wherein the servo-valve moves upon movement of the piston.
Figure 15:
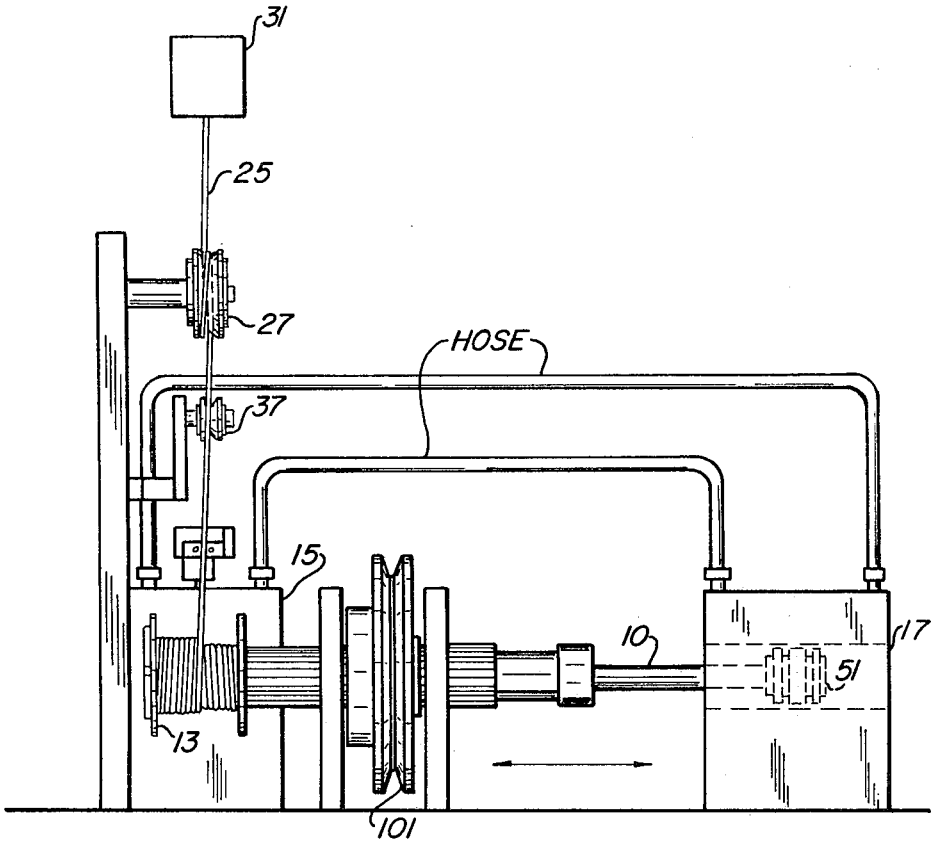
FIG. 15 is a front view of an embodiment wherein the bobbin moves upon movement of the piston.

The above configurations are shown in FIGS. 14 and 15 respectively.

In FIG. 14, cylinder block 17 is separated from servo-valve 15. Pulleys 27 and 37, as well as servo-valve 15, are attached to support arm 41. Flexible hose connects the servo-valve and the guide block. Piston 51 and piston rod 10 are movable with the piston rod connected to servo-valve 15. As the wire is wound about the bobbin, 13, the sensing arm moves generating an error from null in the servo-valve. Hydraulic fluid flows into the cylinder block 17 causing piston 51 and piston rod 10 to move thereby causing corresponding movement of the servo-valve 15 and restoring the null configuration. The bobbin 13 is driven by motor-driven pulley 101.

In FIG. 15, the piston 51 and piston rod 10 are connected to bobbin 13 so that movement of the piston rod causes movement of the bobbin to restore the null configuration.

While the instant invention finds it greatest utility in connection with perfect layer winding and fine wire winding, such as in the manufacture of transformer coils, the apparatus may be utilized for any width, thickness or gauge wire.

FIGS. 8 and 10 show what is referred to hereinabove as a third embodiment of the invention, which differs from the first embodiment only in the construction and design of the sensing arm. As can be seen in FIG. 10, the sensing arm is curved downward, thereby permitting a shorter arm. FIGS. 8 and 10 show the adjustability of the sensing arm. As in the first embodiment (depicted as set screw 33 in FIG. 2), there is a set screw 80 at the terminous of the arm closest to the bobbin so that the sensing fingers may be maintained in proper alignment with the path of wire being wound about the bobbin and a set screw 81 to allow movement of the fingers further from or closer to the bobbin.

FIG. 9 shows an isometric view of the sensing arm, emphasizing the capability of movement of the sensing fingers 23 about set screw 81. This permits a reduction in undesirable vibronic forces caused by the high speeds of the system which may adversely effect the accuracy of the winding.

The movable fingers discussed hereinabove find particular utility in the instant invention due to the high rotational winding speeds which preferably equal or exceed 1000 r.p.m. The coupling of perfect layer wire winding with the high winding speeds achievable by virtue of the instant invention, tend to generate unwanted wire displacements due to the inertia of the sensing arm and wire itself—problems not normally encountered at the lower winding speeds taught in the art.

In perfect layer winding the carriage theoretically doesn't move for approximately $\frac{3}{4}$ of a turn of the bobbin since the wire is in the same plane. On the fourth corner the wire moves one diameter due to the inherent nature of perfect layer winding. Consequently, the movement of the carriage is not continual but rather is characterized by discrete linear displacements. At the high winding speeds realized in the instant invention, the starting and stopping of the carriage sets up undesirable vibronics.

Adjustable fingers tune away the undesirable inertial displacements which may otherwise induce vibronics reducing the wire-winding accuracy of the system.

The positioning of the fingers with respect to the bobbin and servo-valve controls the gain or responsiveness of the servo-valve to wire displacement and constitutes an effective means of dampening inertial forces. The precise speeds at which the undesirable vibronic forces are experienced is dependent in part upon the wire diameter, material and bobbin shape.

Another embodiment of the instant invention, defined as a second embodiment of the invention, is shown in FIGS. 6 and 7. Essentially, relative to FIG. 5, the pulley arm 36 has been shortened considerably and the sensing fingers have been removed and replaced by another pulley 47. Accordingly, the full load of the tensioned wire now falls at the end of the sensing arm 45. While this embodiment may be utilized in the context of the instant invention, it suffers from a substantial diminution in sensitivity, vis-a-vis configurations 1 and 3 where the tensioned wire only comes into contact with the sensing fingers of the sensing arm 21 (FIG. 5) and none of the weight or tension of the wire is experienced by the sensing arm.

Elimination of wire tension and load from the servo-valve, as well as reduction in vibronic forces, act to increase the accuracy and life of the valve system.

The sensing fingers of the instant invention may be adopted to other prior art systems and establishes the benefits experienced in the instant invention.

Stated in other terms, without sensing fingers, the correcting forces impart a heavy load on the sensing arm since the resultant force comprises component forces generated by displacement error and wire tension. With sensing fingers, the correcting force has no wire tension component, therefore, the force lies in the same plane as the movement of the sensing arm.

Thus, for example, the sensing fingers may be substituted for guide pulley 64 on arm 61 and 62 in the U.S. Pat. No. 3,565,357, the disclosure of which is incorporated herein in its entirety as if set forth verbatim. As in the first embodiment herein, the pulley would be attached to the support frame 51 through an arm extending from said support. The wire would then pass over pulley 64 and between the sensing fingers now located at the end of arm 61 and 62. The sensing fingers would be situated below the pulley 64.

By so modifying the '357 invention, comparable benefits of load reduction, vibronic force reduction, increased life of the bearings and greater accuracy in winding are experienced. Similar results may be obtained in connection with the winding device disclosed in U.S. Pat. No. 4,163,531, wherein the pulley 72, is replaced by the sensing fingers of the instant invention. The disclosures in the '531 patent are incorporated herein in their entirety.

Winding wire around a square or rectangular bobbin causes the wire to move back and forth in a plane essentially perpendicular to the axis of the bobbin. This movement creates vibration that can be disruptive to the servo system. In one embodiment of the invention, this problem is minimized by the apparatus shown in FIGS. 20, 21 and 22.

Figure 21:
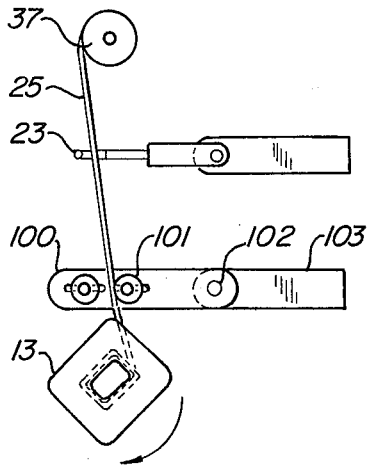
FIG. 21 is a side view of another embodiment of the invention.
Figure 20:
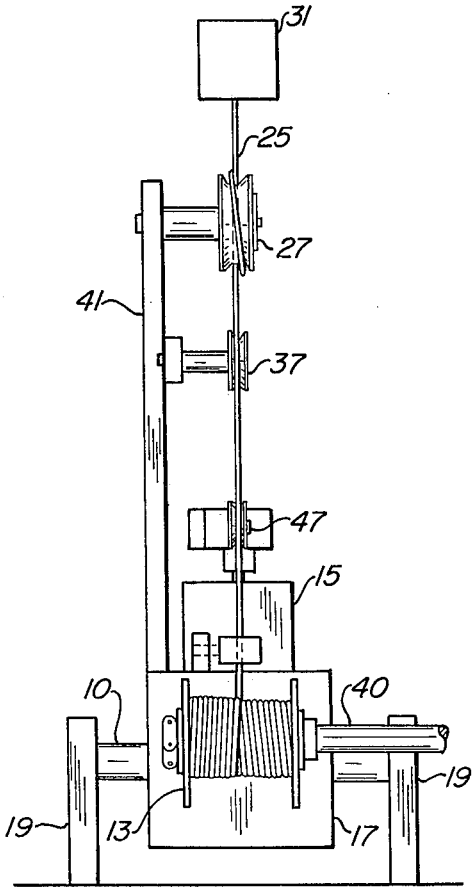
FIG. 20 is a front elevational view of another embodiment of the invention.
Figure 22:
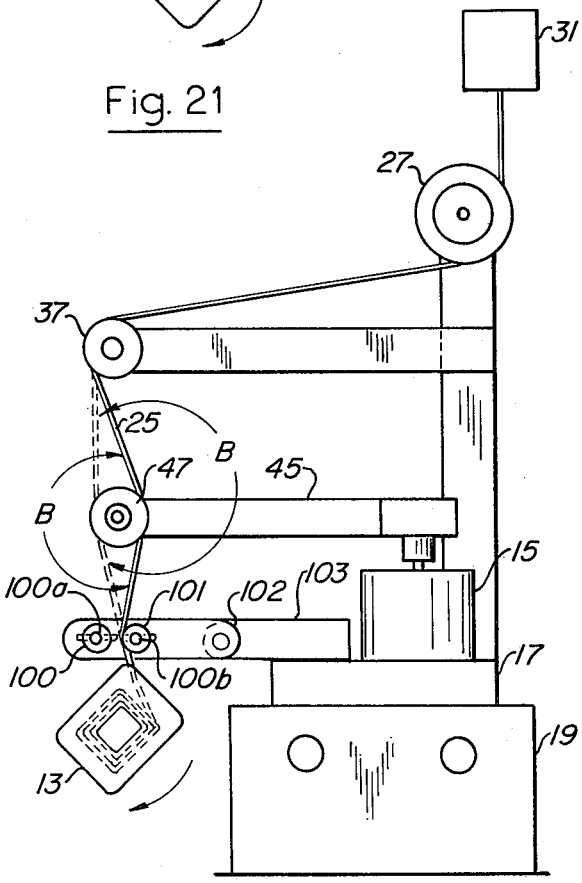
FIG. 22 is a side view of FIG. 20.

In FIG. 22 sensing arm 45 pivotally mounted has pulley 47 situated at its terminus. Dampening arm 103 is attached to guide block 17 and has a pivot point 102. Two cylindrical rollers, 100 and 101 are movably secured to the terminus of arm 103 by lock nuts **100*a* and 100*b* in such a manner that a roller will rotate as wire is run along its surface as it is wound about bobbin 13. The distance between the two rollers is adjustable dependent in part upon the thickness of the wire, the wire material and the winding speed. The rollers may be moved further from or closer to the bobbin by virtue of pivot point 102 to maximize the efficiency of the system. The wire rolling over roller 100 and 101 tends to dampen unwanted vibronics and allows the use of a "V" pulley 47 on the sensing arm as a result of the reduction in vibration and load on the sensing arm itself. The wire is shown as solid and dotted lines respectively to indicate that the angle B formed by the wire leaving pulley 37 and contacting pulley 47 and the wire leaving pulley 47 and contacting the rollers 100 and 101, will also contribute to reducing the vibronic effects—the angle B being determined emperically dependent in part upon the diameter of the wire, the material and the winding speed. FIG. 20 is a front view of FIG. 22. In FIG. 21 another embodiment is illustrated wherein the pulley 47 is replaced by pivotally mounted sensing fingers 23**. Other contemplated embodiments may incorporate 1, 3 or more cylindrical rollers, the number determined empirically.

Empirically determined adjustments, in combination, of one or more of the winding apparatus components comprising the sensing arm and fingers, the dampening rollers and guide pulley 37 and 47, as previously discussed hereinabove, have substantially reduced undesired harmonics inherent in the system caused in part: by the high rotational bobbin speeds (in excess of 5,000 r.p.m. in one embodiment); by the use of non-cylindrical bobbins; and by the nature of perfect layer winding—laying down of the wire in discreet steps across the surface of the bobbin. Coupled with the highly sensitive and responsive balanced hydraulic servo-valves of the instant invention, accurate perfect layer winding at high rotational speeds have been achieved.

Having described the invention, what is claimed is:

1. An apparatus for maintaining a relative position between wire being fed onto a bobbin and wire wound about the bobbin for forming a coil, comprising wire supply means; guide means for guiding the wire onto the bobbin; a sensing arm being movably responsive to shifting of the wire upon winding of said wire onto the bobbin; displacing means for shifting said guide means dependent upon the movement of said sensing arm and therefore the position of the wire wound about the bobbin, whereby as the relative position of the wire being fed onto the bobbin and the wire wound about the bobbin changes, the sensing arm is shifted thereby actuating said displacing means and causing movement of said guide means, thereby reestablishing the relative position between the wire being fed onto the bobbin and the wire wound about the bobbin; said displacing means comprising in combination a hydraulically balanced hydro-mechanical servo-valve, a shaft connecting said valve to said sensing arm, and a hydraulic cylinder containing a piston, said cylinder being in operational communication with said servo-valve, guide means and sensing arm, whereby as said sensing arm shifts in response to said shifting wire, an error from null is generated in the hydraulically balanced hydro-mechanical servo-valve, causing said hydraulic cylinder to move in a direction so as to re-establish null and displacing said guide means to a new position, thereby re-establishing the relative position of the wire being fed onto the bobbin and the wire wound about the bobbin.

2. The apparatus of claim 1 wherein the hydraulic cylinder is secured to the hydraulic servo-valve and shifts responsive to such error from null, thereby moving the guide means, and re-establishing such null.

3. The apparatus of claim 1 whereby a guide pulley is attached to the end of said sensing arm.

4. The apparatus of claim 1 wherein sensing fingers are attached to the end of the sensing arm to reduce undesirable vibronic forces generated by the apparatus and wherein said sensing fingers are situated on either side of the wire which is to be wound about the bobbin and in close proximity thereto.

5. The apparatus of claim 4 including means for mounting said fingers on said sensing arm so that said fingers may be moved further from or closer to the bobbin thereby reducing undesirable vibronic forces which adversely affect the winding accuracy.

6. The apparatus of claim 1 wherein the angle between the wire to be wound about the bobbin and the rotational axis of the bobbin is substantially 90° in the null position.

7. The apparatus of claim 1 wherein said guide means comprises a pulley movably mounted between lock nuts on a threaded rod which extends perpendicularly through a support arm, substantially parallel to the rotational axis of the bobbin whereby said pulley can be moved along said threaded rod by movement of said lock nuts, thereby providing lead-lag adjustment of the wire being wound.

8. The apparatus of claim 1 wherein the wire comprises fine wire and the winding constitutes perfect layer winding.

9. The apparatus of claim 1 wherein the hydraulically balanced hydro-mechanical servo-valve comprises in combination a rotatably mounted servo-valve spool containing small channels cut into its surface; radial and axial passages through which hydraulic fluid flows; and annular passages connecting said axial passages on opposite sides of the servo-valve spool, said servo-valve spool further characterized in that said small channels are separated by lands whose widths are slightly less than the width of the radial passages, so that when the servo-valve is in the null position, the lands are opposite the radial flow passages, resulting in fluid leakage around the lands due to their smaller size relative to the width of the radial passages, creating response sensitivity of the servo-valve to small displacements of the servo-valve spool.

10. The apparatus of claim 1 wherein a dampening arm is interposed between the sensing arm and bobbin, and is attached to said displacing means, and being further characterized by having one or more rollers at the terminus of the dampening arm over which the wire being wound about the bobbin passes to thereby reduce disruptive vibronic forces.

11. An apparatus for maintaining a relative position between wire being fed onto a bobbin and wire wound about the bobbin for forming a coil, comprising wire supply means; guide means for guiding the wire onto the bobbin; a sensing arm being movably responsive to shifting of the wire upon winding of said wire onto the bobbin; displacing means for shifting said bobbin dependent upon the movement of said sensing arm and therefore the position of the wire wound about the bobbin, whereby as the relative position of the wire being fed onto the bobbin and the wire wound about the bobbin changes, the sensing arm is shifted thereby actuating said displacing means and causing movement of the bobbin, whereby the relative position between the wire being fed onto the bobbin and the wire wound about the bobbin is re-established; said displacing means comprising in combination a hydraulically balanced hydro-mechanical servo-valve, a shaft connecting said valve to said sensing arm, and a hydraulic cylinder containing a piston, and wherein said piston is in operational communication with one end of the bobbin, said bobbin being movably mounted while the cylinder is fixed, whereby as said sensing arm shifts in response to said shifting wire, an error from null is generated in the hydraulically balanced hydro-mechanical servo-valve, causing said piston to move and, accordingly, causing movement of the bobbin in a direction so as to re-establish null.

12. An apparatus for maintaining a relative position between wire being fed onto a bobbin and wire wound about the bobbin for forming a coil, comprising wire supply means; guide means for guiding the wire onto the bobbin; a sensing arm being movably responsive to shifting of the wire upon winding of said wire onto the bobbin; displacing means for shifting said guide means dependent upon the movement of said sensing arm and therefore the position of the wire wound about the bobbin, whereby as the relative position of the wire being fed onto the bobbin and the wire wound about the bobbin changes, the sensing arm is shifted thereby actuating said displacing means and causing movement of said guide means, whereby the relative position between the wire being fed onto the bobbin and the wire wound about the bobbin is re-established; said displacing means comprising in combination a hydraulically balanced hydro-mechanical servo-valve, a shaft connecting said valve to said sensing arm, and a hydraulic cylinder containing a piston, said hydraulic cylinder being separate from the hydraulic servo-valve, but the piston contained thereby being in operational communication with the servo-valve, whereby as said sensing arm shifts in response to said shifting wire, an error from null is generated in the hydraulically balanced hydro-mechanical servo-valve, causing movement of the piston and, accordingly, movement of the servo-valve whereby said guide means is moved to a new position thereby re-establishing the relative position of the wire being fed onto the bobbin and the wire wound about the bobbin.

13. An apparatus for maintaining a relative position between wire being fed onto a bobbin and wire wound about the bobbin for forming a coil, comprising wire supply means; guide means for guiding the wire onto the bobbin; and a sensing arm being movably responsive to shifting of the wire upon winding of said wire onto the bobbin; displacing means for shifting said guide means dependent upon the position of the wire wound about the bobbin, whereby as the relative position of the wire being fed onto the bobbin and the wire wound about the bobbin changes, the sensing arm is shifted thereby actuating said displacing means and causing movement of said guide means, whereby the relative position between the wire being fed onto the bobbin and the wire wound about the bobbin is re-established, and wherein a dampening arm is interposed between the sensing arm and bobbin, and is attached to said displacing means, and being further characterized by having one or more rollers at the terminus of the dampening arm over which the wire being wound about the bobbin passes to thereby reduce disruptive vibronic forces.

14. The apparatus of claim 13 wherein said guide means comprises a pulley movably mounted between lock nuts on a threaded rod which extends perpendicularly through a support arm, substantially parallel to the rotational axis of the bobbin whereby said pulley can be moved along said threaded rod by movement of said lock nuts, thereby providing lead-lag adjustment of the wire being wound.

* * * * *